US005383322A

United States Patent [19]

Collins, Jr. et al.

[11] Patent Number: 5,383,322

[45] Date of Patent: Jan. 24, 1995

[54] SINGLE PACK REJECT MECHANISM FOR CIGARETTE PACKAGING MACHINE AND METHOD

[75] Inventors: Joseph L. Collins, Jr., Clemmons; Michael A. Warren, Tobaccoville; Charles F. Demey, III, New Bern; Clifford R. Marritt, Winston-Salem, all of N.C.

[73] Assignee: R. J. Reynolds Tobacco Company, Winston-Salem, N.C.

[21] Appl. No.: 93,375

[22] Filed: Jul. 19, 1993

[51] Int. Cl.[6] ..... B07C 5/00; B65B 57/00

[52] U.S. Cl. ..... 53/53; 53/498; 73/865.8; 209/535

[58] Field of Search ..... 53/53, 54, 498; 73/865.8; 209/535, 536

[56] References Cited

U.S. PATENT DOCUMENTS

| | | | |
|---|---|---|---|
| 3,517,477 | 6/1970 | Thornton | 53/53 |
| 3,590,556 | 7/1971 | Focke | 53/53 |
| 3,899,863 | 8/1975 | Seragnoli et al. | 53/53 |
| 4,053,056 | 10/1977 | Day | 53/53 X |
| 4,814,072 | 3/1989 | Von Wichert et al. | 53/53 X |
| 4,858,770 | 8/1989 | Gamberini | 53/53 X |
| 5,101,609 | 4/1992 | Cook | 53/53 |

*Primary Examiner*—James F. Coan

*Attorney, Agent, or Firm*—Grover M. Myers; George C. Myers, Jr.

[57] ABSTRACT

A cigarette packaging machine is provided with a mechanism for rejecting defective cigarette packs of a two pack stack of cigarette packs. A defective top pack of the stack is rejected at a first rejection station by a blast of pressurized air or a pusher bar and a defective bottom pack of the stack is rejected at a second rejection station downstream of the first rejection station by a movable arm which pivots away from a position supporting the stack and then pivots toward the stack to strike the bottom pack and eject it from the stack. A magazine filled with acceptable packs is located downstream of the second rejection station for replacing defective packs ejected from the stack.

30 Claims, 8 Drawing Sheets

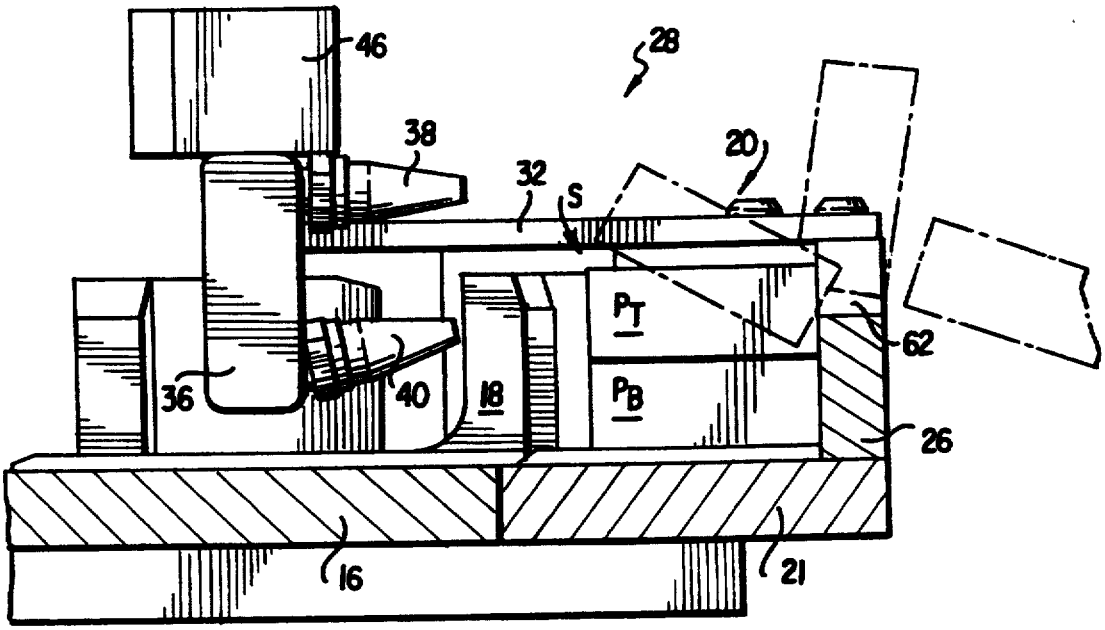
FIG. 4
FIG. 5
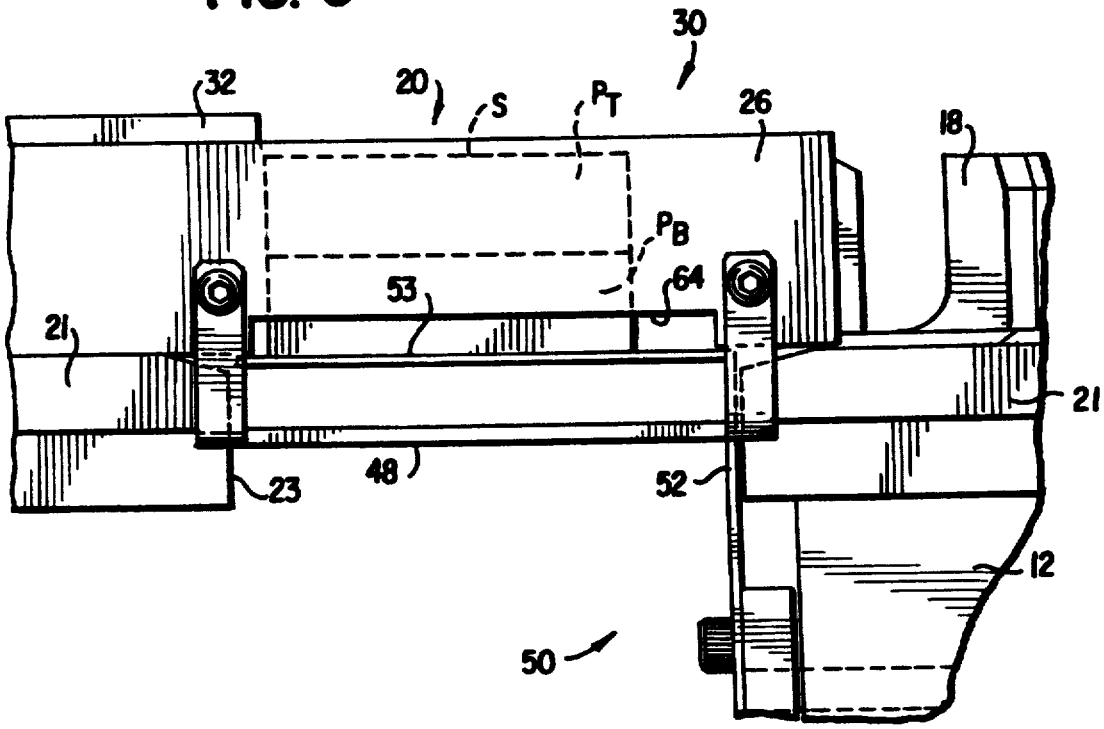

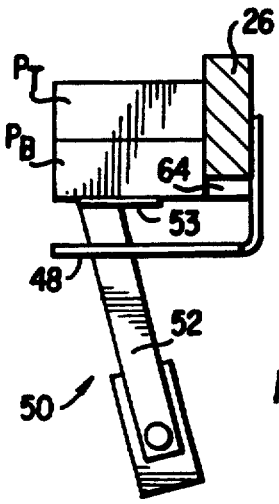
FIG. 6A
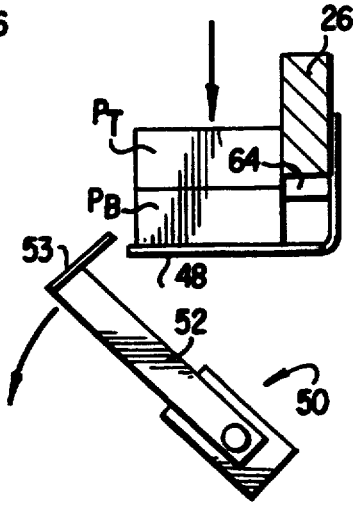
FIG. 6B
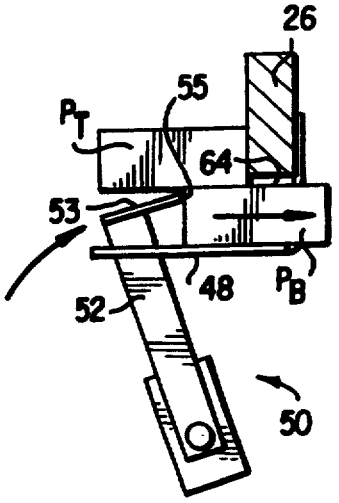
FIG. 6C
FIG. 7
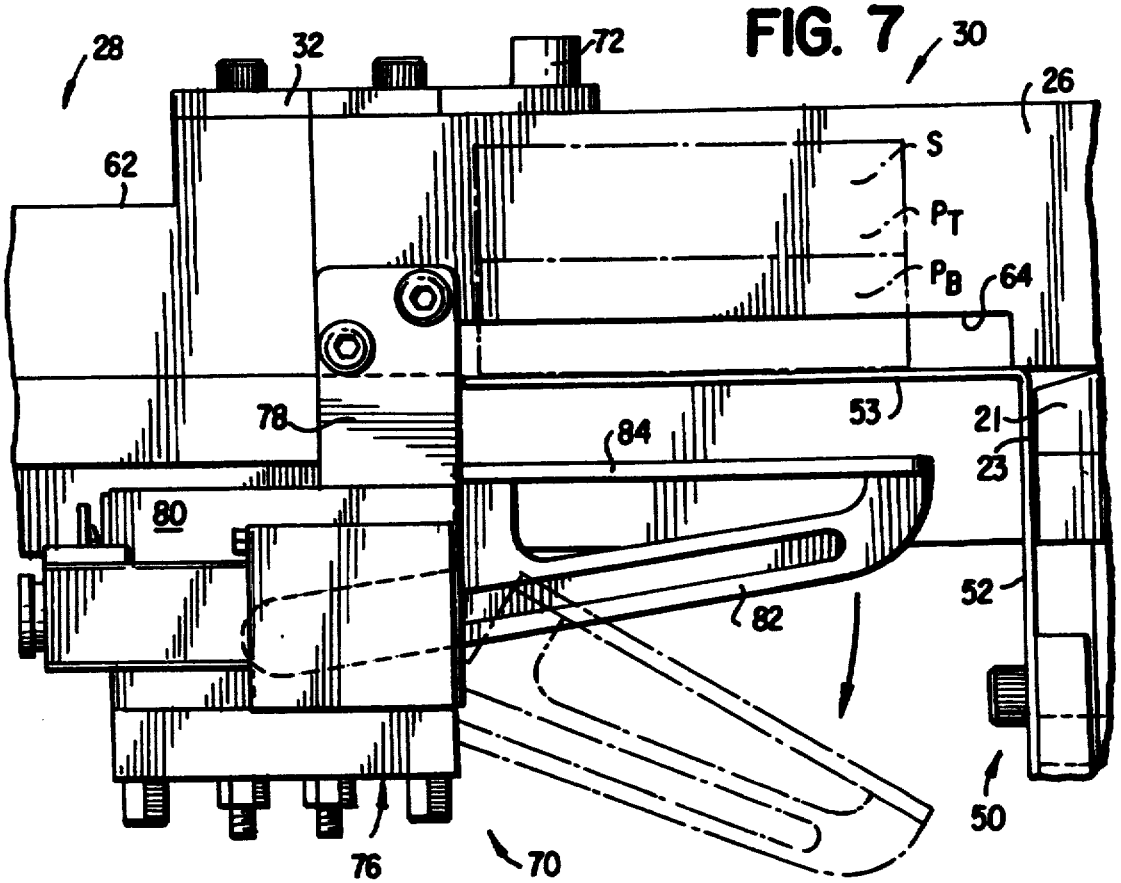

SINGLE PACK REJECT MECHANISM FOR CIGARETTE PACKAGING MACHINE AND METHOD

FIELD OF THE INVENTION

The present invention relates to improvements in cigarette packaging machines and methods and more particularly to a mechanism and method for rejecting the defective pack or packs of a stack of two cigarette packs in an intermittently advanced product stream.

BACKGROUND OF THE INVENTION

Conventional cigarette packaging equipment includes machinery for overwrapping cigarette packages with an overwrap made of either a transparent or metallized polymeric film and having a tear tape for tearing open the overwrap. One such machine is a Model 4350 Packager manufactured by G. D. Societa per Azioni of Bologna, Italy and known as the "GD 4350" machine. In this machine, each cigarette package of twenty cigarettes is individually overwrapped with the polymeric film, heat sealed and then placed in stacks of two packs for delivery by an intermittent motion or indexing turret mechanism to a cigarette cartoner apparatus in which five stacks of two packs (ten packs) are inserted into a cigarette carton. During the overwrapping process, the GD 4350 machine is designed to detect various defects in the cigarette packs, such as, for example, crushed packages, missing or wrinkled overwraps, defective side and end flap seals, missing or misplaced tear tapes and the like. Defective packs are rejected in the GD 4350 machine after the packs have been arranged in the two pack stack configuration. The known machine does not discriminate between an acceptable pack and a defective pack in the two pack stack so that both packs are rejected even if only one pack is defective. The result of this arrangement is that approximately 25% of all rejected packs are acceptable.

U.S. Pat. No. 5,101,609 discloses the prior art package rejection mechanism as well as a recent improvement to the package inspection system of a GD 4350 machine in which each two pack stack of cigarettes is removed from the product stream for inspection by video cameras and is then returned to the product stream for conveyance to the cartoner apparatus. Even in the improved inspection system, if only one defective pack is detected in a two pack stack, both packs of the stack are rejected, again resulting in about 25% of the rejected packs being acceptable packs.

It would be desirable therefore from an economic standpoint to provide a mechanism for the GD 4350 machine or any other comparable apparatus in which only the defective pack of a stack of two packs is rejected and in which both packs are rejected only if both are defective. In addition, it is essential that such mechanism be operable to reject packs from the two pack stack at the maximum production speed of the GD 4350 machine which ranges from about 400 up to about 500 packs per minute (ppm).

SUMMARY OF THE INVENTION

In view of the foregoing limitations and shortcomings of the prior art apparatus, as well as other disadvantages not specifically mentioned above, it should be apparent that there still exists a need in the art for a mechanism and method operable with a GD 4350 machine or its equivalent for rejecting only the defective cigarette pack of a stack of two packs during operation of the machine at or near its maximum production rate.

The present invention fulfills that need by a unique modification to a GD 4350 machine or its equivalent in which only the upper or top pack of a two pack stack of cigarettes is rejected, if defective, at a first pack rejection station on an intermittently rotated turret or transfer wheel of the machine and only the lower or bottom pack of a two pack stack of cigarettes is rejected, if defective, at a second pack rejection station on the turret. A magazine loaded with acceptable packs is arranged downstream of the second pack rejection station to supply a pack to a stack in which one of the packs has been rejected. If both the upper and lower packs are rejected at the first and second pack rejection stations, respectively, a pair of acceptable packs are supplied from the magazine in place of the two rejected packs.

A further or third rejection mechanism is provided at the second pack rejection station for rejecting both packs simultaneously at the second station. This further mechanism is operable when the top pack of the two pack stack is defective, but fails to be ejected from the stack at the first pack rejection station. This condition is usually the result of a slight sticking together of the overwraps of the two packs. This further rejection mechanism may also be programmed to operate in lieu of the top and bottom pack rejection mechanisms at the first and second stations when both packs of a given stack are determined to be defective.

In a preferred embodiment of the invention, a defective top pack of the two pack stack is ejected at the first pack rejection station by means of a short (about 60–150 milliseconds) blast of air at a pressure of about 90 psi supplied to one or more air nozzles arranged radially inwardly of the first pack rejection station. A bottom defective pack of the stack is ejected at the second pack rejection station by means of a first pivotable arm that functions as a movable support plate for the intermittently advanced two pack stacks of cigarettes until a defective bottom pack arrives at the second station. When that occurs, the first pivotable arm swings rearwardly toward the turret rotational axis to cause the two pack stack (or one pack stack if the top pack has previously been ejected at the first station) to drop to a fixed (or movable) support plate. The pivotable arm then swings forwardly to strike and eject the lower pack from the fixed (or movable) support plate and provide a support surface for indexing advancement of the top pack (if present). That top pack will become the bottom pack of a two pack stack when it travels past the magazine containing acceptable packs.

Other embodiments of the invention involve variations in the ejection mechanisms at each pack rejection station. With respect to the embodiment having the third or double pack ejection mechanism at the second rejection station, a second pivotable arm carries a movable pack support plate in lieu of the fixed support plate. The second pivotable arm is pivotable about an axis at right angles to the pivot axis of the first pivotable arm. When both packs of a stack are defective or when a defective top pack fails to be ejected at the first pack rejection station for reasons explained above, the first pivotable arm is swung rearwardly and the second pivotable arm is swung downwardly so that both packs of the stack simultaneously fall downwardly from the second pack rejection station into a chute or other means for collection in a receptacle.

According to the present invention, rejection of the top and bottom packs of a two pack stack advantageously takes place at two different locations on the intermittently rotated or indexed turret of the GD 4350 machine so that the maximum production rate of about 500 packs per minute can be maintained. At that production rate, the dwell time of the packs at each position of turret indexing is about 160 milliseconds. It has been found that if defective top and bottom packs are individually ejected at a single pack rejection station, the dwell time of the packs at the station must be about 200 milliseconds resulting in a reduced maximum production rate of about 400 packs per minute. If both packs of a stack are simultaneously ejected at a single station as in the prior art GD 4350 machine, a dwell time of only about 160 milliseconds is required.

With the foregoing and other objects, advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIG. 4 is a fragmentary side elevation view, partly in cross-section, showing the mechanism for ejecting the top pack of a two pack stack at the first pack rejection station, as viewed in the direction of arrow Y in FIG. 2;

FIG. 5 is a fragmentary front elevation view showing the mechanism for ejecting the bottom pack of a two pack stack at the second pack rejection station as viewed in the direction of arrow X in FIG. 2.

FIGS. 6A–6C are schematic side elevation views of the second pack rejection station showing the sequence of operation of the mechanism for rejecting the bottom pack of the stack;

FIG. 7 is a fragmentary front elevation view of the second pack rejection station showing an alternate embodiment of the invention for rejecting the bottom pack of the stack or both packs of the stack;

DETAILED DESCRIPTION OF THE INVENTION

Figure 1:
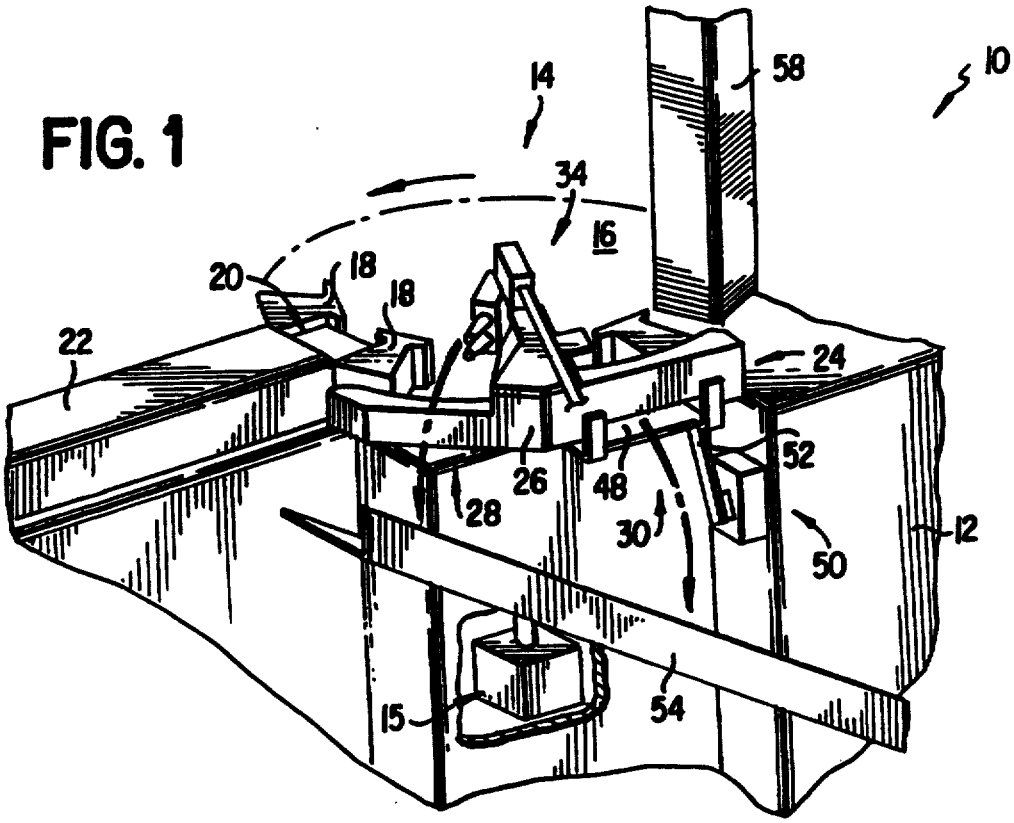
FIG. 1 is a fragmentary perspective view of a portion of a GD 4350 cigarette packaging machine illustrating the present invention installed on the rotatable turret of the machine.
Figure 3:
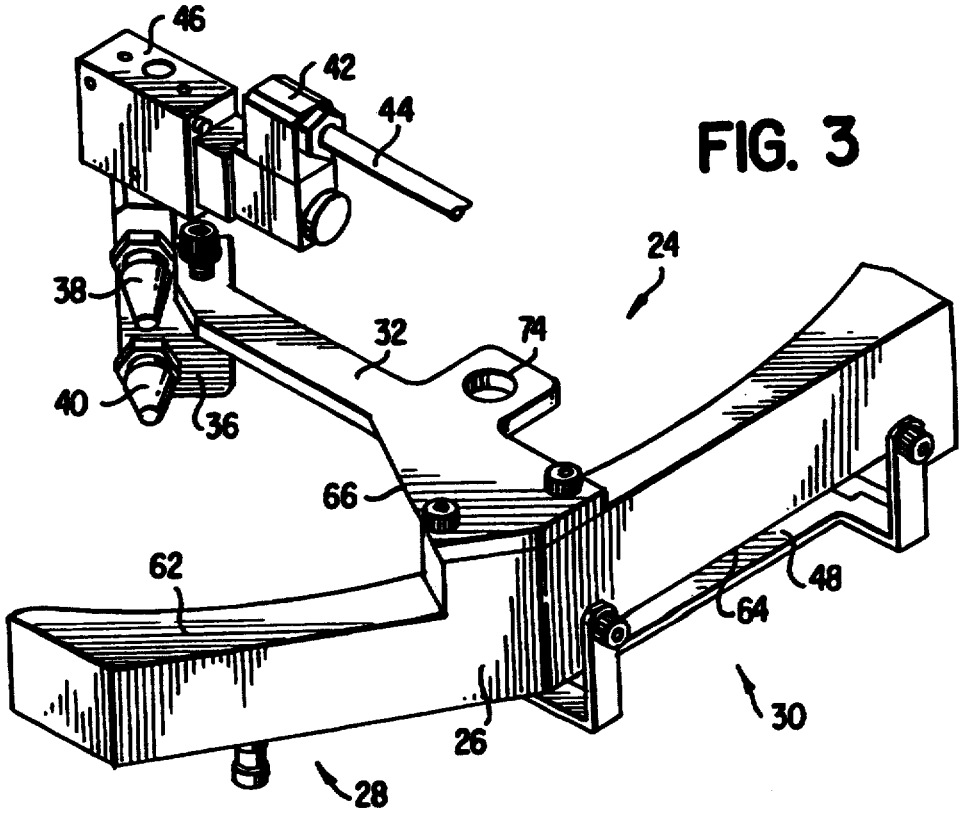
FIG. 3 is a perspective view of a preferred embodiment of the ejection mechanism for incorporating the present invention into a GD 4350 machine.
Figure 2:
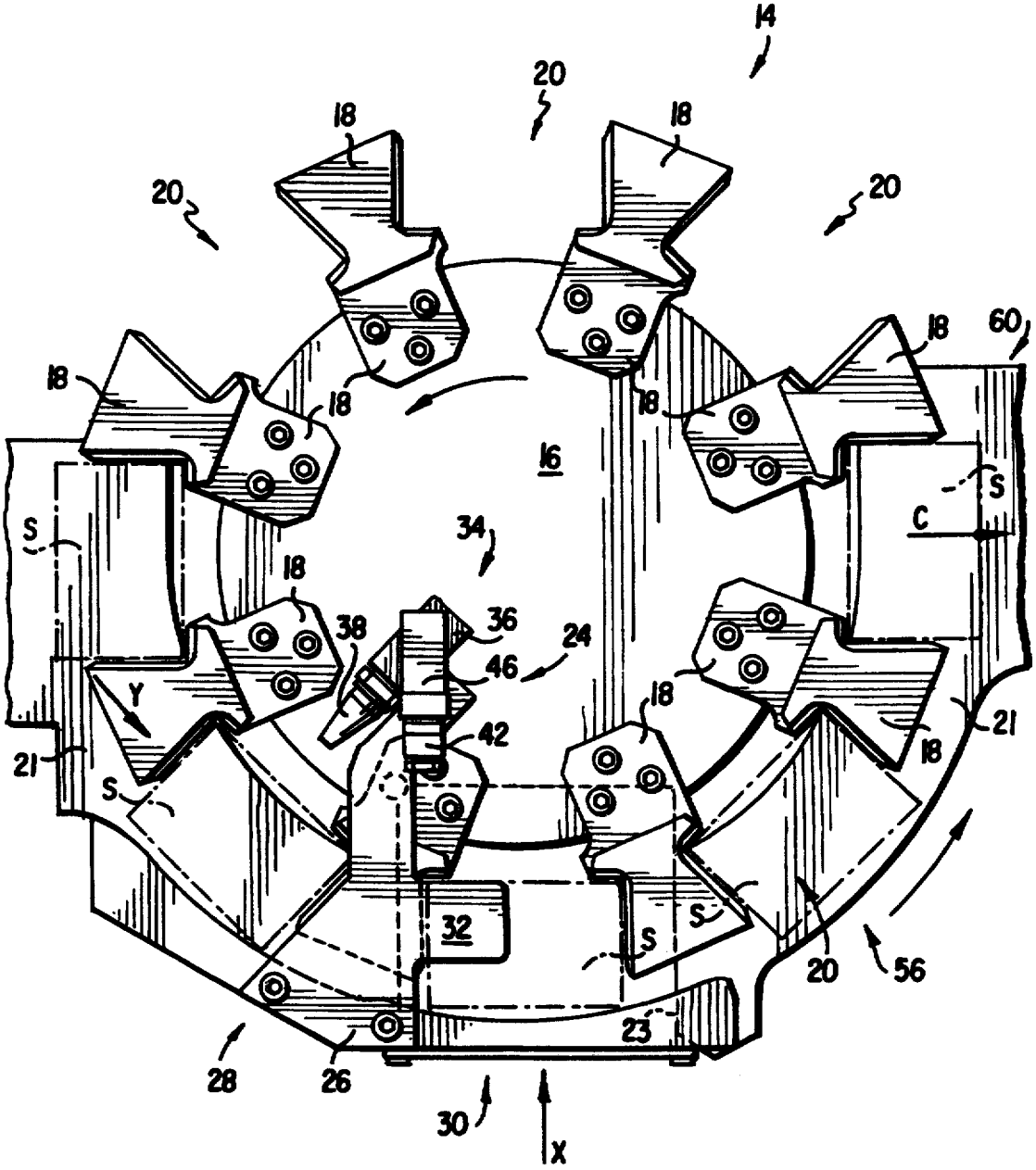
FIG. 2 is a top plan view of the rotary turret of the GD 4350 machine showing the ejection mechanism located at the first and second pack rejection stations.

Referring now in detail to the drawings, and in particular to FIGS. 1–3, the invention is shown incorporated into a cigarette packaging machine known as a GD 4350 machine and is designated generally by reference numeral 10. While the present invention is illustrated as a modification or retrofit to an existing GD 4350 machine, it will be appreciated that the invention may be incorporated into new designs of cigarette packaging machinery or in other types of packaging machinery in which two package stacks are conveyed and defective packages in the stacks are individually rejected. Thus, the present invention is not limited to cigarette packaging machinery but may be advantageously employed in packaging machinery for other types of products. Only so much of the GD 4350 machine is illustrated in the drawings as is necessary to an understanding of the invention. It will also be appreciated that the systems for inspecting the overwrapped cigarette packages for defects and for generating signals to identify defective packs are known in the conventional GD 4350 machine.

Machine 10 comprises a base 12 upon which there is mounted for intermittent rotational movement or indexing a turret or transfer wheel 14. Transfer wheel 14 comprises a rotatable plate 16 provided with a plurality of blocks 18 mounted to the upper surface of the plate 16. Means 15 are provided in the base 12 for incrementally indexing the transfer wheel 14. Blocks 18 are secured at equiangularly spaced positions on the plate and are shaped to define a space or slot 20 dimensioned to receive a two pack stack S of cigarettes (FIG. 2). The stacks of packs in each slot 20 rest on a fixed arcuate plate 21 arranged about the rotatable plate 16 of the transfer wheel. A cut-out 23 is provided in plate 21 for a purpose to be described. The transfer wheel 14 is intermittently indexed in 45° angular increments in a counterclockwise direction as viewed from above with a dwell time at each indexed position of about 160 milliseconds for a maximum production rate of about 500 ppm.

Extending radially toward the transfer wheel 14 from the upstream side thereof is a guideway 22 through which a stream of two pack stacks of overwrapped cigarette packages are intermittently advanced in syncronism with the indexing of the transfer wheel 14 from the overwrapping section of the GD 4350 machine to the slots 20 of the transfer wheel. The GD 4350 machine has a single pack section wherein individual packs are processed, overwrapped, inspected, etc. and a double pack or two pack stack section. The systems for inspection of packs and quality control rejection of individual defective packs are located in the single pack section of the machine and generate signals instructing the machine to reject a particular pack. The pack rejection stations are located in the double pack section of the machine so that it is necessary to create a logical stack position for each individual pack in the double pack section, i.e., a top pack or a bottom pack. Since the two sections of the GD 4350 machine are mechanically linked in an exact 2:1 ratio, timing pulses having that ratio can be used to determine the logical position of the packs in the two pack stack according to the logic shown in the diagram of FIG. 1A.

Figure 1A:
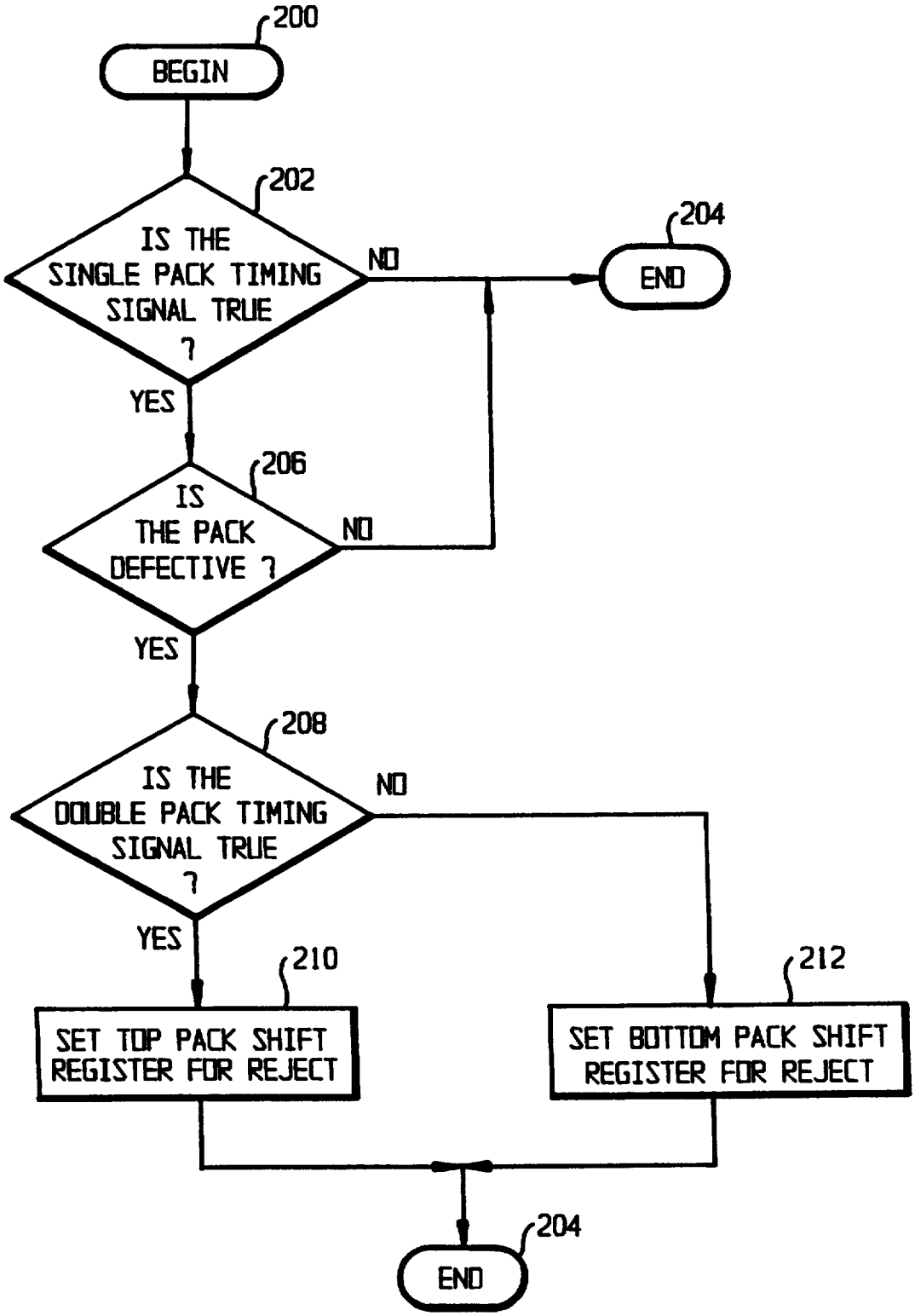
FIG. 1A is a diagram for the logic used to determine where each pack in the single pack section of the GD 4350 machine resides when the pack passes to the double pack or two pack stack section of the machine.

As shown in FIG. 1A, once the logic is invoked, it begins at step 200 and then determines whether the single pack timing signal is true at step 202. The single pack timing signal may preferably be a square wave pulse which occurs once every 360 degrees and is generated by the single pack section of the GD 4350 machine. Two such pulses are generated, one for the top pack and one for the bottom pack. Those signals are passed from the single pack section of the machine to the double pack stack section. If a negative determination is made at step 202, then the logic ends at step 204. If an affirmative determination is made at step 202, then a determination is then made at step 206 of whether the pack is defective. If a negative determination is made at step 206, then the logic ends at step 204.

If an affirmative determination is made at step 206, meaning that a defective pack has been detected, then a determination is then made at step 208 of whether the double pack timing signal is true. The double pack section of the GD 4350 machine generates a square wave timing pulse once every 360 degrees. The width of that timing pulse is approximately twice that of each timing pulse generated by the single pack section. In the event that the timing pulse of the double pack section coincides with one of the timing pulses generated by the single pack section, such coincidence indicates whether a pack passing from the single pack section to the double pack section will reside on the top or the bottom of its respective stack.

If an affirmative determination is made at step 208, then the top pack shift register for reject is set at step 210. If a negative determination is made at step 208, then the bottom pack shift register for reject is set at step 212. After steps 210 and 212, the logic ends at step 204.

Referring again to FIGS. 1–3, the single pack rejection mechanism of the present invention is designated generally by reference numeral 24 and comprises a pack guide bar 26 which is rigidly secured to the plate 21 by suitable fasteners. Pack guide bar 26 retains the stacks S in the slots 20 as the turret is indexed counterclockwise. The pack guide bar 26 also cooperates with the transfer wheel 14 to define a first pack rejection station 28 for ejecting defective top packs of a stack S and a second pack rejection station 30 for ejecting defective bottom packs of a stack S. Rejection stations 28, 30 are arranged 45° apart in adjacent index positions to coincide with the spacing between adjacent slots 20 on the transfer wheel 14. Mounted to pack guide bar 26 by means of a generally radially extending air manifold mounting plate 32 is an air manifold assembly 34. Assembly 34 comprises an air manifold 36 to which is connected a pair of air nozzles 38, 40 oriented in a radially outward direction toward the stack S at the first pack rejection station 26. An air connection 42 supplies compressed air (shop air) at a pressure of about 90 psi from a line 44 to manifold 36 via a solenoid-operated air valve 46.

Suspended from the pack guide 26 at the second pack rejection station 30 is a fixed support plate 48 on which a defective bottom pack rests just prior to ejection at the second pack rejection station 30. The ejecting mechanism 50 at the second station 30 comprises a first L-shaped pivotable arm 52 (FIG. 1) the operation of which is described hereinafter in more detail in connection with FIGS. 5 and 6A–6C.

Packs ejected from the first and second pack rejection stations 28, 30 fall onto an inclined chute 54 where they are delivered to a receptacle (not shown) for recycling or other disposition.

Located at the index position 56 of the transfer wheel 14 is a magazine 58 (FIG. 1) which supplies one or two make-up acceptable packs to each slot 20 when either the top or bottom or both packs of a stack have been ejected. Thus, when the transfer wheel 14 advances from index position 56 to index position 60, the slot 20 at position 60 always contains a two pack stack S of acceptable packs. From index position 60, the stacks S are advanced radially outwardly in the direction of the arrow C to a conventional cartoner apparatus (not shown) associated with the GD 4350 machine.

Referring again to the single pack rejection mechanism 24 shown in FIG. 3, the pack guide bar 26 has a cut-out 62 in its upper edge at the location of the first pack rejection station 28 and a cut-out 64 in its lower edge at the location of the second pack rejection station 30 through which cut-outs a respective defective top pack and bottom pack are ejected as more fully described hereinafter. In addition, the leading edge 66 of the mounting plate 32 is preferably provided with a bevel which has been found to maintain the advancing packs properly positioned in the slots 20 and prevent the packs from riding up or "porpoising." FIG. 4 illustrates the first pack rejection station 28 in more detail and shows how a defective top pack $P_T$ is ejected at station 28. Air nozzle 40 is inclined upwardly at an angle of about 10°–15° and preferably at an angle of about 12.5° such that the axis of the air blast from nozzle 40 intersects the top pack $P_T$ above the midpoint of the height or thickness of pack $P_T$. The air blast from nozzle 40 alone is capable of causing top pack $P_T$ to be ejected over guide bar 26 at cut-out 62 in the manner shown sequentially in phantom lines in FIG. 4. Air nozzle 38 is horizontally directed and may be used optionally to help clear the defective top pack $P_T$ from the first pack rejection station 28. The duration of the air blasts from nozzles 38, 40 is controlled by the solenoid operated air valve 46 and has a duration in the range of about 60–150 milliseconds and preferably about 80–90 milliseconds. The bottom pack $P_B$ is retained in slot 20 by means of the adjacent blocks 18, plate 21 and the guide bar 26. After ejection of defective top pack $P_T$, the bottom pack $P_B$ is advanced to the next index position at the second pack rejection station 30.

Now referring to FIGS. 5 and 6A–6C, operation of the second pack rejection station 30 will be described. When a two pack stack S is advanced to the second station 30, the stack rests on the upper surface of the horizontal portion 53 of the L-shaped pivotable arm 52 (FIGS. 5 and 6A). The horizontal portion 53 normally resides in the slot 23 in the fixed arcuate plate 21 and forms a movable support surface over which the stacks S travel past the second pack rejection station 30. If the bottom pack $P_B$ is defective, the ejection mechanism 50 is signalled to operate. Initially, the pivotable arm 52 swings rearwardly or counterclockwise as shown in FIG. 6B. This causes the stack S to drop by gravity through slot 23 onto the fixed support plate 48. The arm 52 then swings forwardly or clockwise as shown in FIG. 6C. The forward edge 55 of the horizontal arm portion 53 strikes the bottom pack $P_B$ and urges it forwardly or to the right as viewed in FIG. 6C through the cut-out 64 in the guide bar 26 where it falls onto chute 54 for collection. When the pivotable arm 52 returns to its normal position shown in FIG. 6A, the top pack $P_T$ now rests on the horizontal portion 53 and becomes a bottom pack when the transfer wheel 14 is advanced to index position 56 where magazine 58 supplies a make-up top pack to the stack at that location. That stack is then advanced to index position 60 where it is conveyed in the direction of the arrow C to the cartoner apparatus (not shown).

Figure 8:
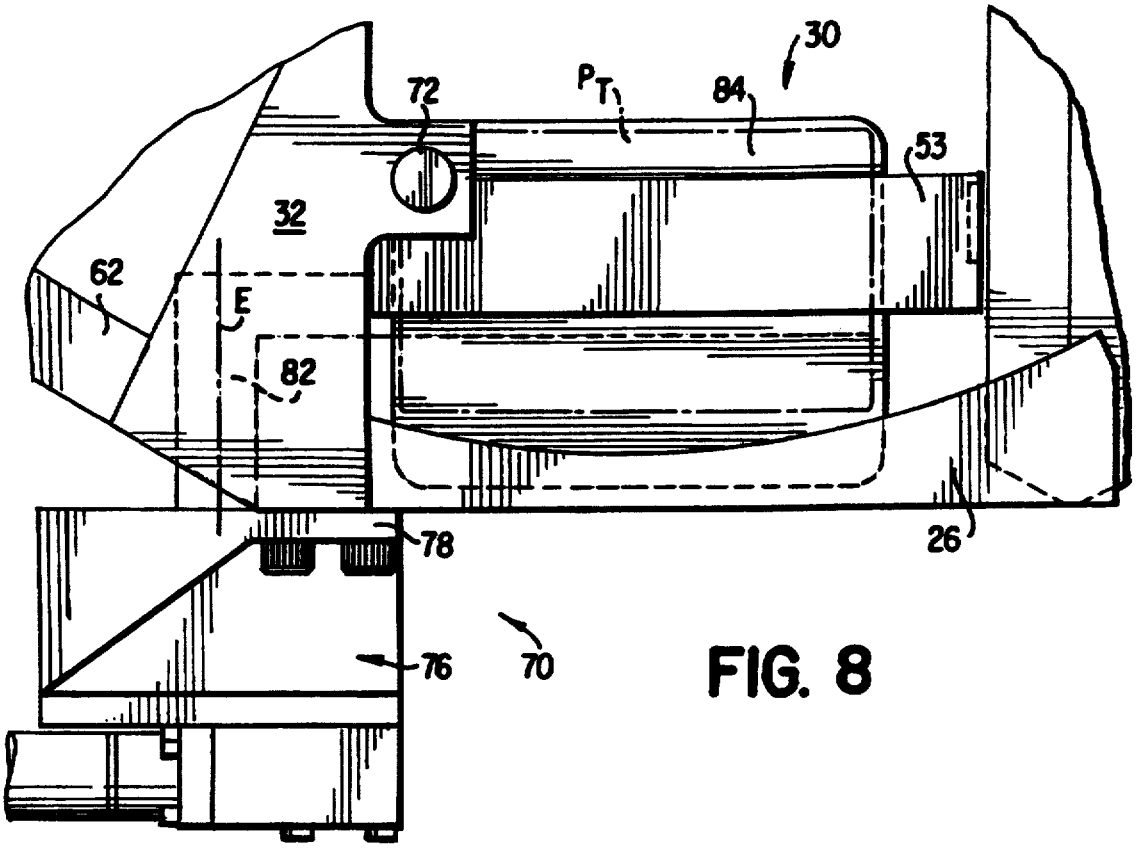
FIG. 8 is a fragmentary top view of the embodiment of the invention shown in FIG. 7.
Figure 9:
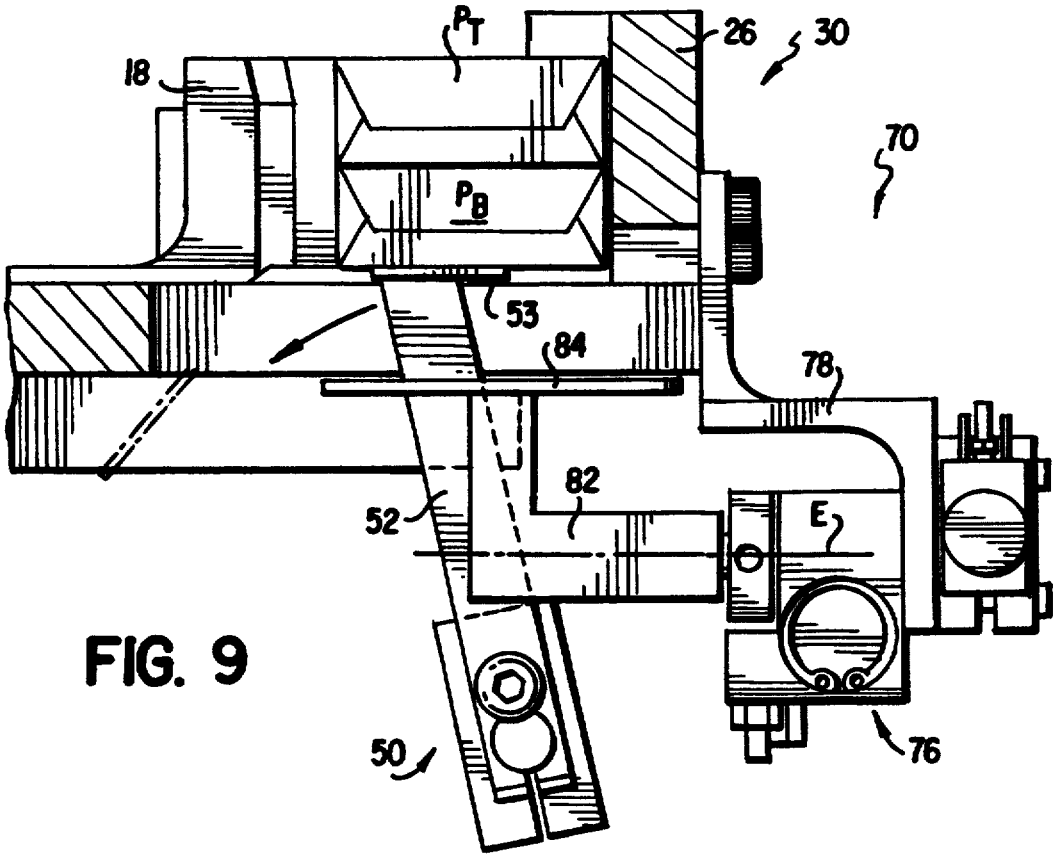
FIG. 9 is a fragmentary side elevation view of the embodiment of the invention shown in FIG. 7.

A further embodiment of the invention is illustrated in FIGS. 7–9. In general, in this embodiment, the first and second pack rejection mechanisms are identical to those described above in connection with FIGS. 1–5 and 6A–6C. The primary difference is that a further or third ejection mechanism designated generally by reference numeral 70 replaces the fixed support plate 48 of the second pack rejection station 30. As previously mentioned, this embodiment is intended to solve the problem that exists when a defective top pack fails to be ejected at the first pack rejection station 28 because, e.g., the two packs are stuck together or, for any other reason, a defective top pack is erroneously advanced to the second pack rejection station 30.

The ejection mechanism 70 comprises a second pivotable arm mechanism 76 suspended from guide bar 26 by means of a bracket 78. The pivotable arm mechanism 76 comprises an operator 80 which may be a pneumatic operator and an L-shaped pivot arm 82 to which is attached a stack support plate 84. Plate 84 performs the same function as fixed support plate 48 in the embodiment of FIGS. 1–5 and 6A–6C. Pivotable arm 82 is pivotable about axis E (FIGS. 8 and 9) so that plate 84 swings clockwise from its horizontal position shown in FIG. 7 to a substantially vertical position clear of the region beneath slot 23.

Operation of the ejection mechanism 70 proceeds as follows. Assume that the top pack $P_T$ of the stack S shown in FIGS. 7–9 is defective and was not ejected at the first pack rejection station 28. A sensor 72, such as a conventional capacitive-type sensor, mounted in an opening 74 (FIG. 3) on air manifold mounting plate 32, detects the presence of defective top pack $P_T$ and sends a signal to a control unit (not shown) for the third ejection mechanism 70 and a signal to the control unit (not shown) for the second ejection mechanism 50. The control units operate both ejection mechanisms 50 and 70 thereby causing pivotable arm 52 to pivot counterclockwise as viewed in FIG. 9 and pivotable arm 82 to pivot clockwise as viewed in FIG. 7 clear of the region below the slot 23. The stack S of packs $P_T$ and $P_B$ at station 30 drops downwardly by gravity through slot 23 onto chute 54 for collection and the ejection mechanisms 50 and 70 return to their normal, solid line positions shown in FIGS. 7–9.

Figure 10:
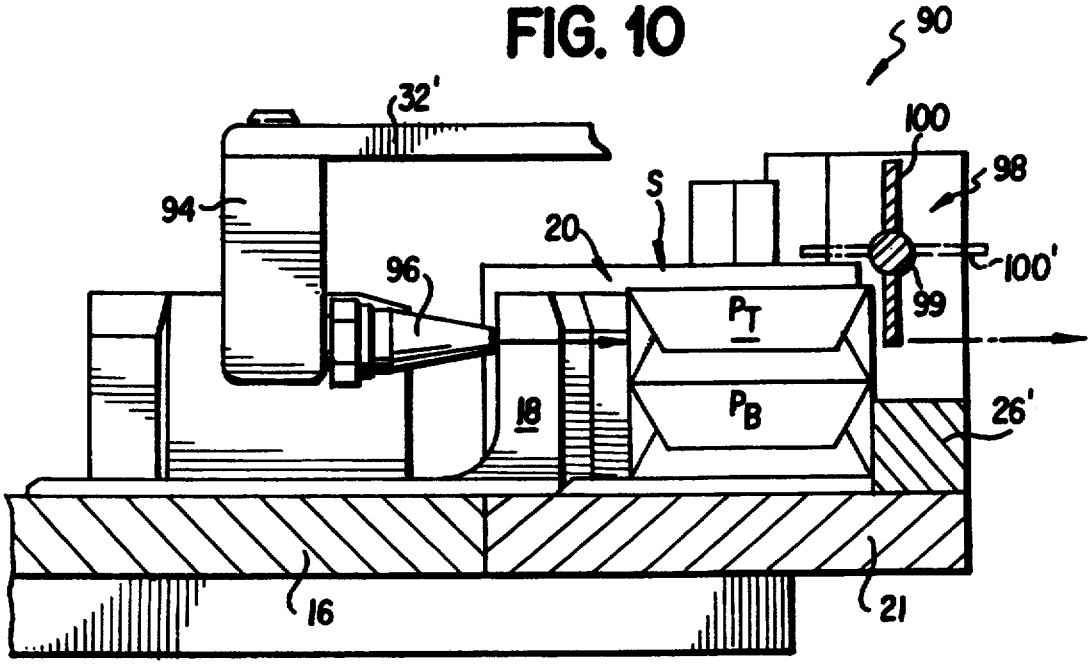
FIG. 10 is a fragmentary side elevation view, partly in cross-section, of an alternate embodiment of the top pack rejection mechanism at the first pack rejection station.
Figure 11:
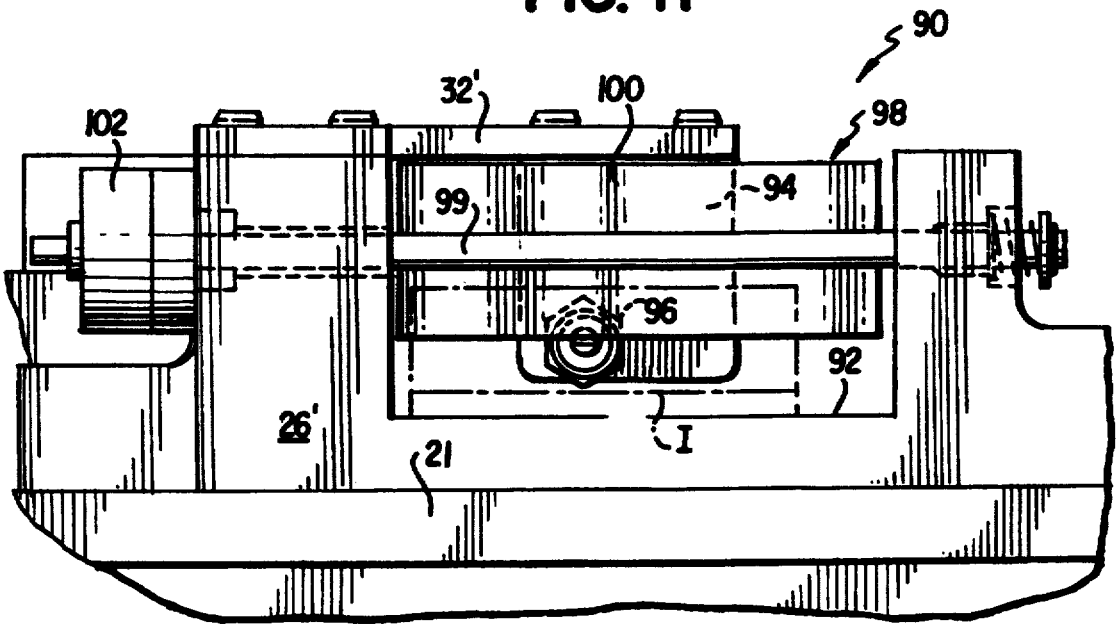
FIG. 11 is a fragmentary front elevation view showing the embodiment of the top pack rejection station of FIG. 10.

FIGS. 10 and 11 illustrate another embodiment of a pack ejection mechanism 90 for ejecting a defective top pack $P_T$. In this embodiment, the pack guide bar 26' is provided with a cut-out 92 that extends below the interface I between the top and bottom packs. An air manifold 94 with a nozzle 96 is mounted to the guide bar 26' by a mounting plate 32'. Nozzle 96 is horizontally directed at the center of the height of top pack $P_T$ so as to eject top pack $P_T$ horizontally from the stack S.

A rotary gate 98 is rotatably mounted in the cut-out 92 of guide bar 26'. Gate 98 comprises a shaft 99 and a flat plate 100 which is vertically oriented in its normal position to retain the top pack $P_T$ on the stack S as shown in solid lines in FIGS. 10 and 11. A rotary actuator 102 is mounted to the shaft 99 for rotating the shaft 90° to the horizontal position shown in phantom lines 100' in FIG. 10. In this position, an air blast from nozzle 96 ejects top pack $P_T$ from the stack S through cut-out 92 and thereafter the rotary gate actuator 102 returns plate 100 to its normal vertical position.

Figure 12:
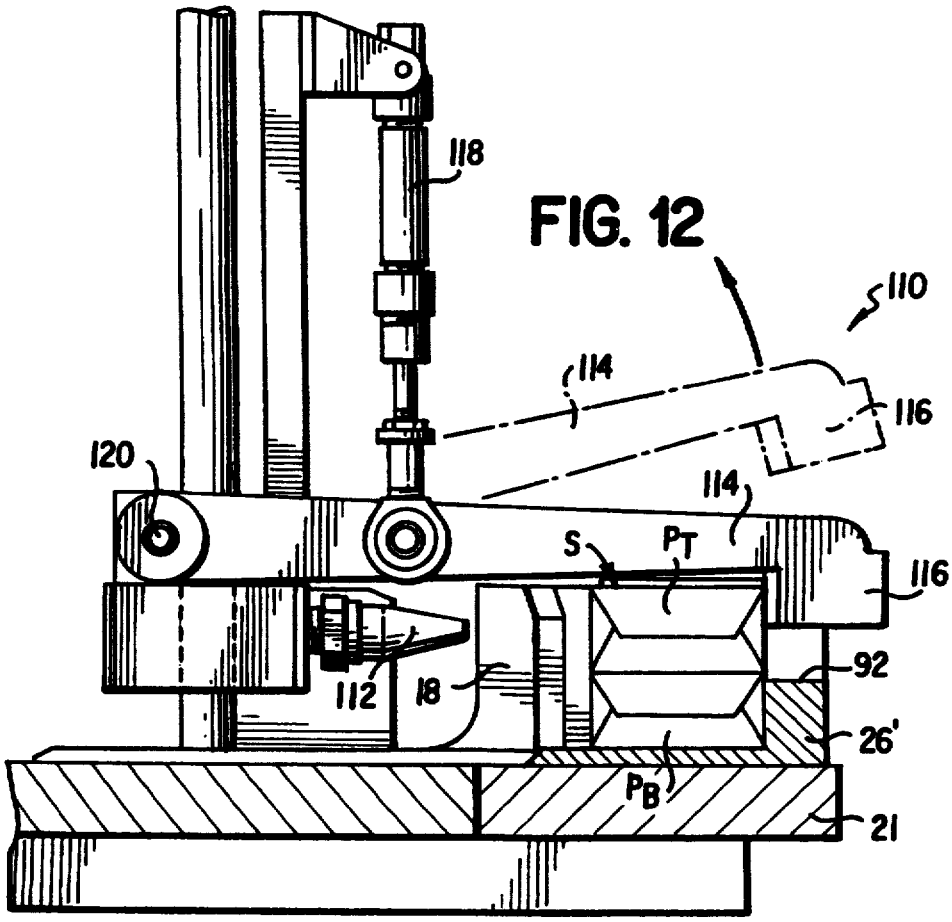
FIG. 12 is a fragmentary side elevation view, partly in cross-section, showing another alternate embodiment of the top pack rejection mechanism at the first pack rejection station.

FIG. 12 illustrates another embodiment of a top pack ejection mechanism 110 for use at the first pack rejection station. This embodiment is similar to the embodiment of FIGS. 10 and 11 in that the top pack $P_T$ is ejected by a horizontally directed air blast from an air nozzle 112. In lieu of the rotary gate 98 of the embodiment of FIGS. 10 and 11, a pivotable arm 114 has an abutment 116 at one end thereof which is normally positioned in cut-out 92 to retain the top pack $P_T$ in the stack S.

When the ejection mechanism 110 is operated to eject the top pack $P_T$, an air cylinder 118 retracts to pivot arm 114 counterclockwise about pivot 120 to the position shown in phantom and a blast of air from air nozzle 112 is initiated to eject top pact $P_T$ horizontally through cut-out 92 for disposal.

Figure 13:
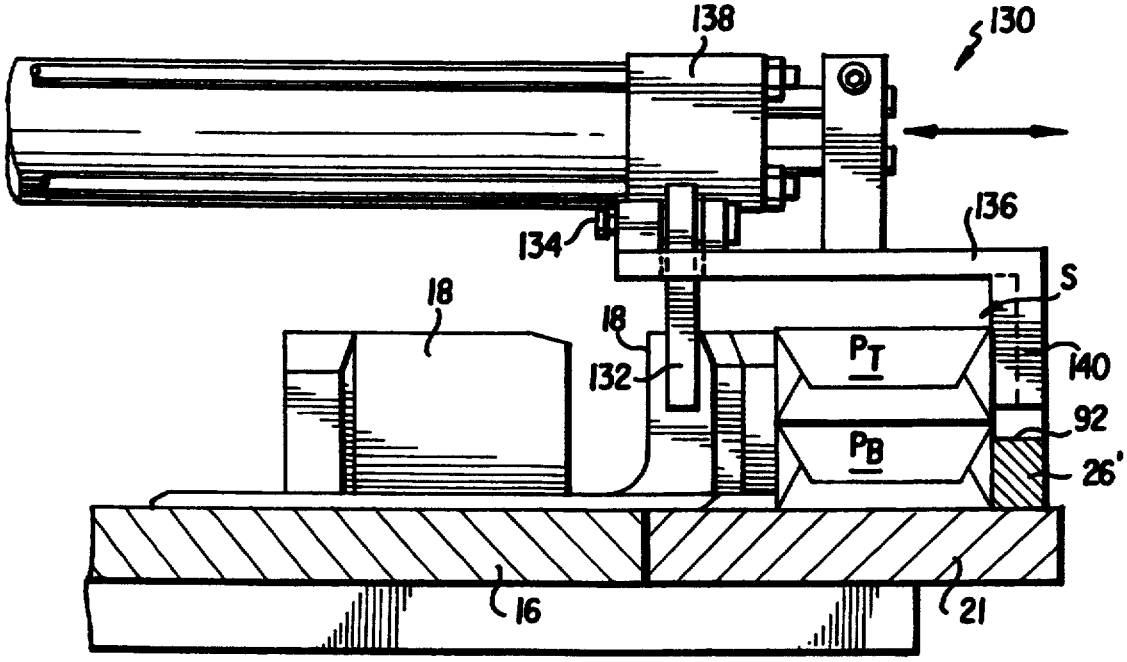
FIG. 13 is a fragmentary side elevation view, partly in cross-section, showing a further alternate embodiment of the top pack rejection mechanism at the first pack rejection station.

FIG. 13 shows yet another embodiment of a top pack ejection mechanism 130 which does not utilize an air blast to eject the top pack. In this embodiment, the top pack $P_T$ is positively ejected by means of a pusher bar 132 which is pivotally suspended by a pin 134 from a support plate 136. Support plate 136 is mounted to a fluid actuator 138, such as a pneumatic or hydraulic actuator, for reciprocation back and forth horizontally as shown by the arrow. Support plate 136 has an integral retainer plate 140 which fits in cut-out 92 to retain the top pack $P_T$ on the stack S. Pusher bar 132 is pivoted from pin 134 to prevent possible interference between the transfer wheel components and the pusher bar during indexing.

When the ejection mechanism 130 receives a signal to eject a defective top pack $P_T$, the actuator 138 is operated to move support plate 136 to the right whereby the pusher bar 132 urges the top pack $P_T$ also to the right through cut-out 92 for disposal. Advantageously, operation of only the actuator 138 is required with this embodiment since the retainer plate 140 is simultaneously movable with the pusher bar 132.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A cigarette packing machine comprising:

means for identifying a defective pack in a two pack stack moving along a path of travel, said stack having a top pack and a bottom pack;

first rejection means located at a first position of said two pack stack along said path of travel for rejecting only said defective pack disposed as the top pack of said two pack stack; and second rejection means independent of said first rejection means located at a second position of said two pack stack along said path of travel and spaced from said first position for rejecting only said defective pack disposed as the bottom pack of said two pack stack.

2. A cigarette packaging machine comprising:

means for identifying a defective pack in a two pack stack having a top pack and a bottom pack;

first rejection means for rejecting only said defective pack disposed as the top pack of said two pack stack;

second rejection means independent of said first rejection means for rejecting only said defective pack disposed as the bottom pack of said two pack stack;

a transfer wheel;

means for retaining a plurality of said stacks on said transfer wheel; and means for rotatably indexing said transfer wheel about an axis to convey said stacks along a path of travel, said transfer wheel having a plurality of indexing positions, said first rejection means being located at a first one of said indexing positions, and said second rejection means being located at a second one of said indexing positions located downstream of said first indexing position.

3. The cigarette packaging machine of claim 2, wherein said first rejection means comprises at least one air nozzle having a nozzle axis, said nozzle axis being directed at the top pack of a two pack stack at said first indexing position, a source of pressurized air, means for selectively connecting said pressurized air to said air nozzle whereby air from said nozzle is operative to eject the top pack from said two pack stack at the first indexing position.

4. The cigarette packaging machine of claim 3, wherein said first rejection means further comprises first and second air nozzles selectively connected to said source of pressurized air, said first nozzle being horizontally directed along an axis disposed above the top pack of said two pack stack, said second nozzle being disposed beneath the first nozzle with the axis thereof directed at an upwardly inclined angle toward the top pack of said two pack stack.

5. The cigarette packaging machine of claim 4, wherein said upwardly inclined angle is from about 10° to about 15°.

6. The cigarette packaging machine of claim 2, including a pack guide bar mounted to said machine adjacent said transfer wheel, said pack guide bar having upper and lower surfaces, a first cut-out in said upper surface at the first indexing position through which the top pack of a two pack stack is ejected, and a second cut-out in said lower surface at the second indexing position through which the bottom pack of a two pack stack is ejected.

7. The cigarette packaging machine of claim 2, wherein said second rejection means comprises a movable arm located at said second indexing position, said movable arm having a horizontal portion on which the two pack stacks are supported as they pass along the path of travel, a fixed support plate located beneath the path of travel of the two pack stacks, said movable arm being selectively operative to move away from a two pack stack at said second indexing position so as to permit such stack to drop by gravity onto said fixed support plate, and then to move toward such two pack stack so as to strike the bottom pack of such stack, eject it from such stack and support the top pack of such stack on the horizontal portion of the movable arm.

8. The cigarette packaging machine of claim 7, wherein said horizontal portion has a lengthwise axis, said movable arm comprising an L-shaped pivotable arm having a pivot axis parallel to the lengthwise axis of the horizontal portion of said arm.

9. The cigarette packaging machine of claim 2, wherein said second rejection means comprises first and second movable arms located at said second indexing position, said first movable arm having a horizontal portion on which the two pack stacks are supported as they pass along the path of travel, said second movable arm having a support plate located beneath the path of travel of the two pack stacks, said first movable arm being selectively operative to move away from a two pack stack at said second indexing position so as to permit such stack to drop by gravity onto the support plate of said second movable arm, and then to move toward such two pack stack so as to strike the bottom pack of such stack, eject it from such stack and support the top pack of such stack on the horizontal portion of the first movable arm, said second movable arm being selectively operative to move the support plate from beneath the path of travel so as to permit both packs of said two pack stack to drop by gravity from the path of travel when said first movable arm moves away from a two pack stack at the second indexing position.

10. The cigarette packaging machine of claim 9, wherein said horizontal portion of the first movable arm has a lengthwise axis, said first and second movable arms comprising first and second pivotable arms, respectively, said first pivotable arm comprising an L-shaped arm having a first pivot axis parallel to the lengthwise axis of the horizontal portion of said first pivotable arm, said second pivotable arm having a second pivot axis substantially at right angles to the first pivot axis.

11. The cigarette packaging machine of claim 2, including means disposed beneath said first and second indexing positions for collecting the defective packs ejected by said first and second rejection means.

12. The cigarette packaging machine of claim 3, wherein said air nozzle is horizontally directed at the top pack of the stack at the first indexing position, a pack guide bar mounted to said machine adjacent said transfer wheel, said pack guide bar having a cut-out therein at said first indexing position through which the top pack of a two pack stack is ejected by pressurized air from said air nozzle, means disposed in said cut-out for retaining the top pack of the stack in the path of travel, and means for moving said retaining means so as to permit ejection of the top pack of the stack through said cut-out by pressurized air from the air nozzle.

13. The cigarette packaging machine of claim 12, wherein said retaining means comprises a rotary gate disposed in said cut-out and rotatably mounted to said pack guide bar and means for rotating said gate.

14. The cigarette packaging machine of claim 12, wherein said retaining means comprises a pivotable arm having an abutment at one end thereof, said abutment having a retaining position in said cut-out, and means for pivoting said arm so as to move said abutment away from its retaining position in said cut-out.

15. The cigarette packaging machine of claim 2, wherein said first rejection means comprises a pusher bar mounted at said first indexing position and means connected to said pusher bar for horizontally moving said pusher bar into engagement with the top pack of a two pack stack at said first indexing position to eject such top pack.

16. The cigarette packaging machine of claim 15, including a support plate mounted to said pusher bar moving means, said pusher bar being pivotally mounted to said support plate about an axis parallel to the axis of movement of said pusher bar.

17. The cigarette packaging machine of claim 16, including a pack guide bar mounted to said machine adjacent said transfer wheel, said pack guide bar having a cut-out therein at said first indexing position through which the top pack of a two pack stack is ejected by said pusher bar, said support plate including a retainer plate depending therefrom and disposed in said cut-out for retaining said top pack in the path of travel until said support plate and pusher bar are moved to eject the top pack of a stack.

18. The cigarette packaging machine of claim 17, wherein said pusher bar moving means comprises a fluid actuator.

19. The cigarette packaging machine of claim 2, including magazine means disposed at a third one of said indexing positions located downstream of said second indexing position for supplying make-up packs to a stack in which one or both of the packs of a stack have been ejected.

20. A defective cigarette pack rejection apparatus for a cigarette packaging machine having a transfer wheel including means for retaining a plurality of two pack stacks having a top pack and a bottom pack, means for rotatably indexing said transfer wheel about an axis to a plurality of indexing positions, and means for identifying a defective pack of said two pack stacks comprising first rejection means located at a first indexing position for ejecting only a defective top pack of the two pack stack, second rejection means independent of said first rejection means located at a second indexing position for rejecting (1) only a defective bottom pack of the two pack stack or (2) both packs of the two pack stack.

21. The cigarette pack rejection apparatus of claim 20, including a pack guide bar having upper and lower surfaces mounted adjacent said transfer wheel, said guide bar having a first cut-out in the upper surface thereof at the first indexing position and a second cut-out in the lower surface of the guide bar at the second indexing position, said first rejection means comprising at least one air nozzle connected to a source of pressurized air for ejecting a defective top pack from the stack through said first cut-out, said second rejection means comprising first and second pivotable arms disposed at said second indexing position with the second pivotable arm having a support plate disposed beneath the first pivotable arm, said first pivotable arm having a horizontal portion on which said two pack stacks are supported and guided, said first pivotable arm being selectively operative to pivot the horizontal portion away from the two pack stack supported thereon and permit such stack to drop by gravity onto the support plate of the second pivotable arm and then to pivot toward such two pack stack so as to strike the bottom pack of such stack and eject it through said second cut-out, said second pivotable arm being selectively operative to pivot the support plate thereof from beneath the two pack stack when said first pivotable arm is pivoted away from such two pack stack to thereby eject both packs of such two pack stack.

22. A method of rejecting a defective pack from a cigarette packaging machine in which the packs are stacked into a plurality of two pack stacks each with a top pack and a bottom pack, comprising the steps of;

identifying defective top and bottom packs of said two pack stacks;

conveying said two pack stacks past a first rejection station and a second rejection station downstream of said first rejection station;

rejecting only defective top packs of said two pack stacks at said first rejection station;

rejecting defective bottom packs of said two pack stacks at said second rejection station; and supplying make-up packs to said stacks downstream of said second rejection station to replace the top and bottom packs rejected at said first and second rejection stations.

23. The method of claim 22, wherein said defective top pack rejecting step comprises the steps of indexing a two pack stack with a defective top pack to said first rejection station, and ejecting said defective pack with at least one blast of pressurized air.

24. The method of claim 22, wherein said second rejection station comprises a first movable arm with a horizontal portion and a support surface mounted beneath said horizontal portion, said defective bottom pack rejecting step comprising the steps of indexing a stack with a defective bottom pack to said second rejection station, supporting said stack on the horizontal portion of the first movable arm, then moving the horizontal portion of said first movable arm away from the stack to permit said defective bottom pack to drop by gravity onto the support surface, and then moving the horizontal portion of the first movable arm toward the defective bottom pack to strike such defective bottom pack and eject it from the support surface of the second rejection station.

25. The method of claim 24, wherein said first movable arm is pivotably movable, said moving steps comprise pivoting said first movable arm.

26. The method of claim 24, including the step of moving the support surface from beneath the horizontal portion of the first movable arm so as to permit the top and bottom packs of the two pack stack at the second rejection station to drop by gravity from the second rejection station.

27. The method of claim 26, wherein the step of moving the support surface comprises pivoting said support surface.

28. A cigarette packaging machine comprising:

means for conveying a plurality of two pack stacks along a path of travel, said two pack stacks having a top pack and a bottom pack, said two pack stacks including defective packs and acceptable packs;

means for identifying a defective pack in a two pack stack;

first rejection means for rejecting only a defective pack disposed as the top pack of said two pack stack by moving only said defective pack out of said path of travel; and second rejection means for rejecting only a defective pack disposed as the bottom pack of said two pack stack by moving only said defective bottom pack out of said path of travel;

all acceptable packs of said two pack stacks remaining in said path of travel and being moved by said conveying means along said path of travel.

29. The cigarette packaging machine of claim 28, wherein said first rejection means is located at a first position along said path of travel of said two pack stacks and said second rejection means is located at a second position spaced from said first position along said path of travel of said two pack stacks.

30. The cigarette packaging machine of claim 28, wherein said first and second rejecting means are operative to eject defective top and bottom packs respectively at different positions of said two pack stacks along said path of travel.

* * * * *